United States Patent [19]

Matviets et al.

[11] 4,178,792

[45] Dec. 18, 1979

[54] HIGH-SPEED ANVILLESS HAMMER

[76] Inventors: Petr P. Matviets, ulitsa Lizjukova 43, kv. 167; Iosif L. Makhtjuk, prospekt Truda 60, kv. 11; Valentin I. Grigoriev, ulitsa Pushkinskaya 36, kv. 73; Mark M. Zaidlin, ulitsa Geroev Sibiryakov 24, kv. 158, all of, Voronezh; Alexandr I. Khotilin, ulitsa Novo-Sadovaya 15, kv. 21, Kuibyshev; Jury N. Krasnov, ulitsa Fizkulturnaya 129, kv. 35, Kuibyshev; Isaak R. Khaimovich, ulitsa Juria Pavlova 3, kv. 8, Kuibyshev, all of U.S.S.R.

[21] Appl. No.: 897,265

[22] Filed: Apr. 18, 1978

[51] Int. Cl.[2] ..... B21J 7/28

[52] U.S. Cl. ..... 72/436; 72/432; 72/453.05

[58] Field of Search ..... 72/312, 354, 432, 436, 72/453.01, 453.02, 453.05, 453.1, 453.11; 267/119

[56] References Cited

U.S. PATENT DOCUMENTS

| | | | |
|---|---|---|---|
| 1,903,475 | 4/1933 | Rhodes | 267/119 |
| 3,064,507 | 11/1962 | Strugala et al. | 72/453.02 |

*Primary Examiner*—Lowell A. Larson

*Attorney, Agent, or Firm*—Fleit & Jacobson

[57] ABSTRACT

A hammer comprises a bed in the guides of which is mounted a frame, the latter being supported on cushions. The frame mounts a hammer head provided with a dirve for imparting thereto an axial reciprocating motion. The hammer head drive includes a power cylinder with a piston and a piston rod. The hammer head is located in a central hole provided in the piston rod and has a working tool which is attached to the lower end thereof and is situated above a die block.

The stroke of the piston exceeds the distance between the die block and the lower end of the piston rod. With the piston in the lowermost position, the piston rod in conjunction with the surface of the die block forms a closed zone around the hammer head, in which zone deformation of the blank is effected. The hammer head is provided with a mechanism for retention thereof in the initial position. Provision is also made for a mechanism for lifting the hammer head into the initial position after a blow.

5 Claims, 1 Drawing Figure

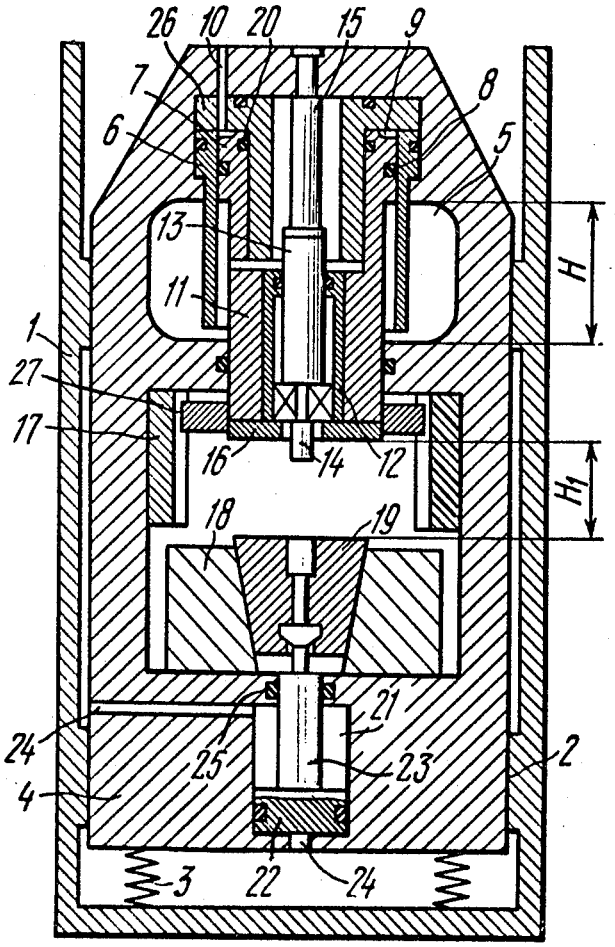
26
10
20
15
9
7
8
6
5
13
H
11
1
27
17
16
14
12
H1
18
19
21
24
25
23
2
4
3
22
24

HIGH-SPEED ANVILLESS HAMMER

The present invention relates to the field of forge and press machine building and has particular reference to high-speed anvilless hammers designed for high-speed forming of parts from metals and alloys difficult to be deformed.

Widely known in the art are high-speed hammers comprising a movable frame situated inside a bed and bearing onto cushions.

It has been known to provide a high-speed hammer comprising a bed and a cushion-mounted frame vertically movable in bed guides. The upper crossmember of the frame mounts a tup and the upper half of a die, the lower crossmember of the frame mounts the lower half of a die.

The upper crossmember of the frame accomodates a power chamber designed to impart movement to the tup rod and the frame through a working medium and also mounts a tup rod retention mechanism constructed in the form of a rubber vacuum sucker.

Hydraulic lifts are provided for moving the tup into the initial striking position.

The machine under consideration suffers from the following disadvantages: the working medium (usually nitrogen) is wasted due to being forced out of the power chamber as the tup rod is raised into the initial position; the blow energy is unstable; the construction of the machine is complicated; the working cycle of the machine is lengthened because of the necessity to exhaust the working medium into the atomosphere and measure the charge of gas fed into the working chamber.

Moreover, the machine has the following substantial drawbacks: low operating dependability of the tup retention mechanism; sharp decrease in the rate of deformation during the regulation of gas pressure in the power chamber; provision of tup lifts, which decreases the working space of the hammer; low technological capacity of the machine in making forgings from metals and alloys difficult to be deformed and also in making parts the shape of which does not permit them to be knocked out from the die; low thermal and mechanical durability of the tool because of a relatively long period of contact thereof with the hot forging. Inasmuch as the tup lifts are located in the lower cross-member of the frame, the tup cannot be raised until the oscillations of the frame-tup system have ceased after a blow.

Known in the art is a high-speed hammer operating on the principle of an internal combustion engine. It consists of two basic parts: a drive comprising a combustion chamber, inlet and exhaust valves, an ignition plug and an injector; and a driven machine which is provided with a tup, guides, a bed and a device for sharp release of the energy of the combustion products.

Said machine suffers from the disadvantage that the rate of deformation decreases in proportion to decrease in the blow energy. Another disadvantage is that rough regulation of the blow energy (within 10 percent) adversely affects the life of the dies and the machine itself.

The excess of energy above the optimum value does not provide for obtaining accurate dimensions of parts in closed spaces of dies, variation in the dimensions of parts being in direct proportion to the excess of energy.

If the blow energy becomes less than the nominal value, the hammer loses its properties of high-speed deformation inasmuch as the rate of deformation decreases in proportion to decrease in the energy.

The hammer under consideration also suffers from the disadvantages that it has no sound deadening screens in the zone of deformation and needs the use of special systems for cooling the hammer drive and additional means for drawing out exhaust gas. Furthermore, said hammer cannot be used for stamping sheet stock and doing stamping sheet stock and doing stamping jobs in sectional dies due to lack of devices for moving out sectional-die inserts and of blank holders.

It is an object of the present invention to improve, the accuracy of stamping.

It is another object of the present invention to increase technological capacity of a high-speed hammer.

It is a further object of the present invention to provide greater safety in operating a high-speed hammer.

It is a still further object of the present invention to lower noise level in the operation of a high-speed hammer.

These and other objects are achieved in a high-speed anvilless hammer comprising a bed, a frame supported on cushions and mounted in the guides of the bed, and a hammer head mounted on the frame and provided with a drive which is designed to impart an axial reciprocating motion to said hammer head and is constructed in the form of a power chamber with a working medium contained therein and a power cylinder with a piston and the rod thereof, a stamping space being provided underneath the rod of the power cylinder, in which stamping space are located a die block and a working tool, the latter being mounted above the die block on the lower end of said hammer head, which hammer head is provided with a mechanism for retention thereof in the initial position.

According to the invention, the piston rod has a central hole which is situated in the portion of said piston rod nearest the stamping space, is sealed at the end nearest the power chamber and accomodates said hammer head, the stroke of the piston exceeding the distance between the die block and the lower end of the piston rod, due to which, when the piston is in the lowermost position, a closed zone is formed around the hammer head between the piston rod and the die block, in which zone deformation of the blank is effected. The hammer also comprises a means for lifting the hammer head to the hammer head retention mechanism after a blow.

The design of a high-speed hammer which constitutes the present invention provides for separating the blow zone from the stamping space, whereby hammer operating noise is decreased considerably and the safety of hammer operation is improved.

The possibility of using a hammer head having a small mass provides for sharp increase in the blank deformation rate and for accurate metering of kinetic energy required for forming blanks.

The provision of a hammer head guide hole in the piston rod makes for accurate positioning of the working tool in relation to the die block, which enhances the quality of stampings and prolongs the life of the tool.

Since the stroke of the piston exceeds the distance between the die block and the lower end of the piston rod, the piston rod is pressed against the die, whereby provision is made for stamping of sheet stock, for finish working of metals and for forging the blanks in sectional dies.

Said hammer design provides for increasing the extent of metal deformation, the depth of drawing stampings, the technological capacity of the hammer and the working life of the dies involved.

According to one of the embodiments of the invention, the hammer head has a guide made in the form of a bushing mounted in the central hole provided in the piston rod, the length of said bushing exceeding the stroke of the hammer head.

It is desirable that the means for lifting the hammer head be made in the form of a flange mounted on the end of the piston rod so as to extend underneath the end face of the hammer head for the purpose of retaining it before a blow and lifting it into the initial position after a blow.

This constructional arrangement permits the tool to be quickly withdrawn from contact with hot deformed metal, thereby increasing durability of the tool and decreasing the duration of the working cycle of the hammer.

According to another embodiment of the invention, provision is made of a means for preventing axial rotation of the piston rod, said means being constructed in the form of guiding elements mounted on the frame and arranged to mate with guiding surfaces provided on the flange.

This constructional arrangement improves the positioning of the working tool relative to the die.

For a further understanding of the other objects and advantages of the present invention, an embodiment thereof will now be described in detail with reference to the accompanying drawing in which:

FIG. 1 is a longitudinal sectional view of the hammer according to the invention.

The high-speed anvilless hammer constituting the present invention comprises a bed 1 (FIG. 1) secured to a foundation (now shown). Mounted in the guides 2 of the bed 1 and supported on cushions 3 is a frame 4 the upper portion of which accomodates a power chamber 5 filled with a working medium, for example, an inert gas. Mounted in the power chamber 5 is a power cylinder 6, the latter being rigidly connected with the frame 4. The power cylinder 6 accomodates a piston 7. With the aid of seals 8 and 20 the piston 7 separates the chamber 5 from the space 9 above the piston. A passage 10 connects the space 9 above the piston through a valve (not shown) to an external source of working medium (not shown).

The piston 7 has a rod 11 which has a central hole with a bushing 12 installed therein. The inside guiding hole of the bushing 12 in cross section has the shape which prevents the axial rotation of the piston rod. A hammer head 13 has a working tool 14 attached to the bottom end thereof and is arranged to reciprocate in an insert 26. The hammer head 13 is held in the initial position by a hammer head retention mechanism 15 installed inside the bushing 12. The length of the bushing 12 is to be greater than the stroke of the hammer head 13.

Rigidly secured to the end of the piston rod 11 is a flange 16 provided with guiding surfaces 27 which may have the cross-sectional shape of a prism, a circle, an ellipse, etc. The flange 16 extends underneath the end face of the hammer head 13 for the purpose of retaining it before a blow and lifting it into the initial position after a blow. The guiding surfaces of the flange 16 mate with the guides 17 of the frame 4.

The stroke H of the piston 7 exceeds the distance $H_1$ between the flange 16 and the die block 18 which comprises sectional dies 19 and is mounted in the lower portion of the frame 4. The stroke of the hammer head 13 is to be less than the distance $H_1$.

Mounted in the bottom portion of the frame 4 is a power cylinder 21 with a piston 22 and a piston rod 23. Passages 24 for supplying power liquid (thin mineral oil) to the cylinder 21 are also provided in the bottom portion of the frame 4. The power cylinder 21 serves the purpose of drawing the dies 19 together and moving them apart. The rod 23 of the piston 22 is made tight by provision of seal 25.

The hammer operates as follows.

Liquid under pressure is delivered through passage 10 into space 9 above the piston 7. The pressure of the liquid moves the piston 7 down together with the rod 11 and the flange 16. During the downward travel of the piston 7 the hammer head 13 is held in the initial position by the mechanism 15, whereas the working medium in the chamber 5 becomes compressed, the pressure of the working medium rising.

With the piston 7 in the lowermost position, the piston rod 11 presses against the die block 18 or a sheet-stock blank (not shown). The interior of the piston rod 11 in conjunction with the die block 18 forms a closed zone wherein deformation of the blank is effected.

Thereafter the mechanism 15 is actuated for the hammer head 13 to strike. The hammer head 13 disengages from the mechanism 15 and, under the action of the potential energy of the working medium contained in the chamber 5, strikes the blank (not shown) situated in the die block 18. The liquid is forced from the space 9 through a valve (not shown) and the passage 10 by the working medium contained in the chamber 5. The piston 7, acting through the flange 16, returns the hammer head 13 together with the tool 14 into the initial position. The hammer head 13 with the tool 14 is held in the initial position by the mechanism 15 and also by the flange 16. The produced part is removed from the die block 18 and thereafter the hammer is ready to strike again.

The die block 18 can be provided with solid or sectional dies.

We claim:

1. A high-speed anvilless hammer comprising: a bed; guides provided on said bed; a frame supported on cushions and mounted in said bed guides; a hammer head mounted on said frame; a working tool mounted on the lower end of said hammer head; a die block mounted underneath said working tool; a drive for imparting an axial reciprocating motion to said hammer head so that said hammer head moves between an initial position and a work position, in which the working tool strikes a workpiece, said drive being constructed in the form of a power chamber with a working medium contained therein and a power cylinder with a piston and a piston rod; retention means for retaining said hammer head in the initial position; said piston rod having a central guide hole which is situated in the piston rod portion nearest the die block, is sealed at the end nearest said power chamber and accommodates said hammer head; the stroke of said piston exceeding the distance between said die block and the lower end of said piston rod, due to which, when the piston is in a lowermost position, a closed zone is formed around said hammer head between said piston rod and the surface of said die block in which zone deformation of the blank is effected; means operative after formation of the closed zone for releasing said hammer head from said retention means so that said drive moves said hammer head to said work position; and means for lifting said hammer head to the said retention means after the working tool strikes a workpiece.

2. A high-speed anvilless hammer as claimed in claim 1, in which said hammer head has a guide in the form of a bushing mounted in a central hole provided in the piston rod, the length of said bushing exceeding the stroke of the hammer head.

3. A high-speed anvilless hammer as claimed in claim 1, in which the means for lifting the hammer head is made in the form of a flange mounted on the end of the piston rod so as to extend underneath the end face of the hammer head for the purpose of retaining it before a blow and lifting it into the initial position after a blow.

4. A high-speed anvilless hammer as claimed in claim 1, further comprising means for preventing axial rotation of said piston rod, said means being constructed in the form of guiding elements provided on said frame and arranged to mate with a guiding surface provided on a flange connected to said rod.

5. A high-speed anvilless hammer as claimed in claim 1, wherein said power cylinder has an open upper end, and wherein an insert extends into the open upper end, said piston having an external surface movably guided by the power cylinder and an internal surface movably guided on the insert.

* * * * *